US007310963B2

(12) United States Patent
Crocker

(10) Patent No.: US 7,310,963 B2
(45) Date of Patent: Dec. 25, 2007

(54) AUTOMATIC DRAIN DOCKING SYSTEM FOR HVAC MODULE DRAIN PIPE

(75) Inventor: Glenn Crocker, Marietta, GA (US)

(73) Assignee: DENSO International America, Inc., Southfield, MI (US)

( * ) Notice: Subject to any disclaimer, the term of this patent is extended or adjusted under 35 U.S.C. 154(b) by 540 days.

(21) Appl. No.: 11/054,415

(22) Filed: Feb. 9, 2005

(65) Prior Publication Data

US 2006/0199506 A1 Sep. 7, 2006

(51) Int. Cl.
*F25D 21/14* (2006.01)

(52) U.S. Cl. ..... 62/285; 62/239; 454/233

(58) Field of Classification Search ..... 62/239, 62/244, 279, 285; 454/145, 150, 233
See application file for complete search history.

(56) References Cited

U.S. PATENT DOCUMENTS 6,048,263 A * 4/2000 Uchida et al. ..... 454/121
6,382,305 B1 * 5/2002 Sano ..... 165/43

* cited by examiner

*Primary Examiner*—Melvin Jones
(74) *Attorney, Agent, or Firm*—Harness, Dickey & Pierce, PLC

(57) ABSTRACT

A mounting arrangement for an HVAC case includes a drain tube extending from the HVAC case and defining an outlet. A receiving portion extends from a docking station and is adapted to accept the drain tube in an assembled position. A first compressible material is disposed between the receiving portion and the docking station. The receiving portion is operable to deflect into the first compressible material upon slidable communication of the drain tube along a surface of the neck. A second compressible material is disposed between the drain tube and the receiving portion. The second compressible material is adapted to compress between the drain tube and the receiving portion in the assembled position.

20 Claims, 5 Drawing Sheets

AUTOMATIC DRAIN DOCKING SYSTEM FOR HVAC MODULE DRAIN PIPE

FIELD OF THE INVENTION

The present invention relates to HVAC systems in vehicles and more particularly to a drain tube and docking arrangement for an HVAC case.

BACKGROUND OF THE INVENTION

In automotive vehicles, it is common to have a climate control system located within an instrument panel which provides heated or cooled air to occupants through dash panel defrost air outlets, instrument panel venting air outlets and floor directed air outlets. These traditional climate control systems often include a heater core that performs heat exchange between the engine coolant, which is heated by the engine, and the cool air in the cabin/outside environment, in order to provide warm air to the passenger compartment. Some vehicles include an air conditioning system that cooperates with an evaporator for absorbing heat from the air in the vehicle. The heater core and evaporator are typically provided in an HVAC case located in the passenger compartment of the vehicle.

During operation, low pressure refrigerant flowing into the evaporator absorbs heat from the air inside the HVAC case for evaporation. Typically with a relatively high ambient temperature, condensation forms on the evaporator and drips onto a bottom surface of the HVAC case. In one arrangement, a drain tube directs the fluid through an outlet to an inlet of a docking station where it is discharged onto the ground. In many instances it is difficult and awkward to properly align the outlet of the drain tube with the inlet of the docking station during assembly.

SUMMARY OF THE INVENTION

A mounting arrangement for an HVAC case includes a drain tube extending from the HVAC case and defining an outlet. A neck extends from a docking station and is adapted to accept the drain tube in an assembled position. A first compressible material is disposed between the neck and the docking station. The neck is operable to deflect into the first compressible material upon slidable communication of the drain tube along a surface of the neck.

According to other features the neck is operable to rotate into the first compressible material upon slidable communication of the drain tube along the surface of the neck. A second compressible material is disposed between the drain tube and the neck. The second compressible material is adapted to compress between the drain tube and the neck in the assembled position.

According to still other features the drain tube defines a flange extending radially therearound. The flange defines a conical cross section. The drain tube defines a bulbous distal insertion end. The neck includes a funnel portion arranged on a first end. An intermediate collar extends radially around the neck. The first compressible material is disposed between the intermediate collar and the docking station.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
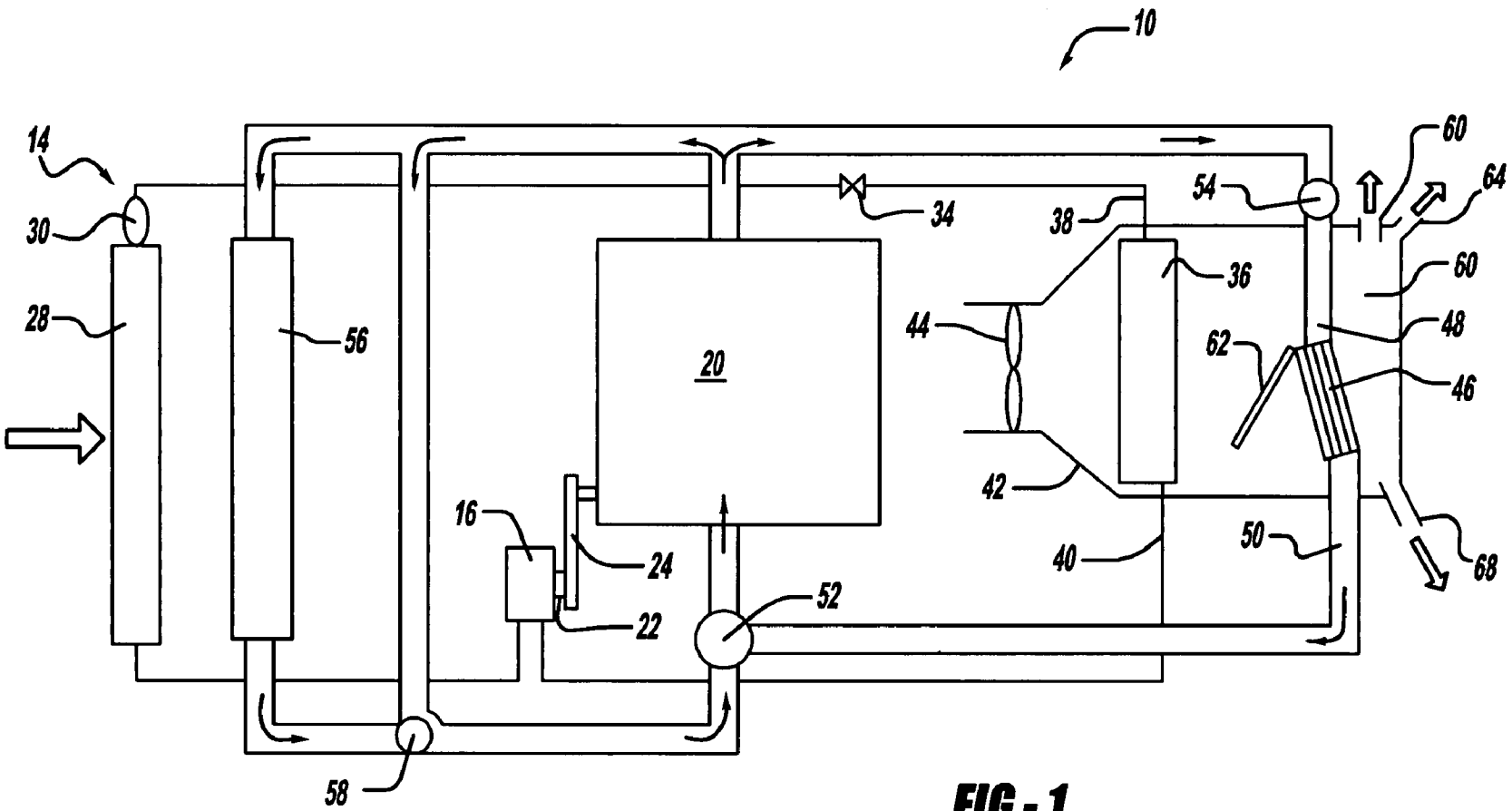
FIG. 1 is a functional block diagram of an HVAC system of a vehicle.

With initial reference to FIG. 1, a block diagram of a vehicle HVAC system according to the present teachings is shown and generally identified at reference 10. A refrigeration cycle R of the vehicle HVAC system 10 includes an air-cooling system 14. The air-cooling system 14 includes a compressor 16 which draws, compresses, and discharges a refrigerant. The power of a vehicle engine 20 is transmitted to the compressor 16 through pulleys 22 and a belt 24.

As is well known, the vehicle engine 20 drives not only the air conditioning compressor 16 but also such auxiliaries as a generator, a hydraulic pump for a power steering unit, and a coolant pump via belts and other power transmitting devices.

In the refrigeration cycle R, the compressor 16 discharges a superheated gas refrigerant of high temperature and high pressure, which flows into a condenser 28. Here, heat exchange is performed with the outside air sent by a cooling fan (not shown), so that the refrigerant is cooled for condensation. The refrigerant condensed in the condenser 28 then flows into a receiver 30, in which the refrigerant is separated into a gas and a liquid. A redundant liquid refrigerant in the refrigeration cycle R is stored inside the receiver 30.

The liquid refrigerant from the receiver 30 is decompressed by an expansion valve 34 into a gas-liquid double phase state of low pressure refrigerant. The low pressure refrigerant from the expansion valve 34 flows into an evaporator 36 by way of an inlet pipe 38. The evaporator 36 is arranged inside an HVAC case 42 of the vehicle air conditioning system 14. The low pressure refrigerant flowing into the evaporator 36 absorbs heat from the air inside the HVAC case 42 for evaporation. An outlet pipe 40 of the evaporator 36 is connected to the suction side of the compressor 16, so that the cycle components mentioned above constitute a closed circuit.

The HVAC case 42 forms a ventilation duct through which air conditioning air is sent into the passenger compartment. The HVAC case 42 contains a fan 44 which is arranged on the upstream side of the evaporator 36. An inside/outside air switch box (not shown) is arranged on the suction side of the fan 44 (the left side in FIG. 1). The air inside the passenger compartment (inside air) or the air outside the passenger compartment (outside air) switched and introduced through the inside/outside air switch box is sent into the HVAC case 42 by the fan 44.

The HVAC case 42 accommodates, on the downstream side of the evaporator 36, a hot water heater core (heat exchanger) 46. The heater core 46 includes an inlet pipe 48 and an outlet pipe 50. Hot water (coolant) of the vehicle engine 20 is directed to the heater core 46 through the inlet pipe 48 by a water pump 52. A water valve 54 controls the flow volume of engine coolant supplied to the heater core 46. A radiator 56 and a thermistor 58 further cooperate to control the temperature of the coolant.

A bypass channel 60 is formed beside the hot water heater core 46. An air mix door 62 is provided to adjust the volume ratio between warm air and cool air that passes through the hot water heater core 46 and the bypass channel 60, respectively. The air mix door 62 adjusts the temperature of the air blown into the passenger compartment by adjusting the volume ratio between the warm air and cool air.

Additionally, a face outlet 64, a foot outlet 68, and a defroster outlet 70 are formed at the downstream end of the HVAC case 42. The face outlet 64 directs air toward the upper body portions of passengers, the foot outlet 68 directs air toward the feet of the passengers, and the defroster outlet 70 directs air toward the internal surface of a windshield. The outlets 64, 58 and 70 are opened and closed by an outlet mode doors (not shown). The air mix door 62 and the outlet mode doors mentioned above are driven by such electric driving devices such as servo motors via linkages or the like.

Figure 2:
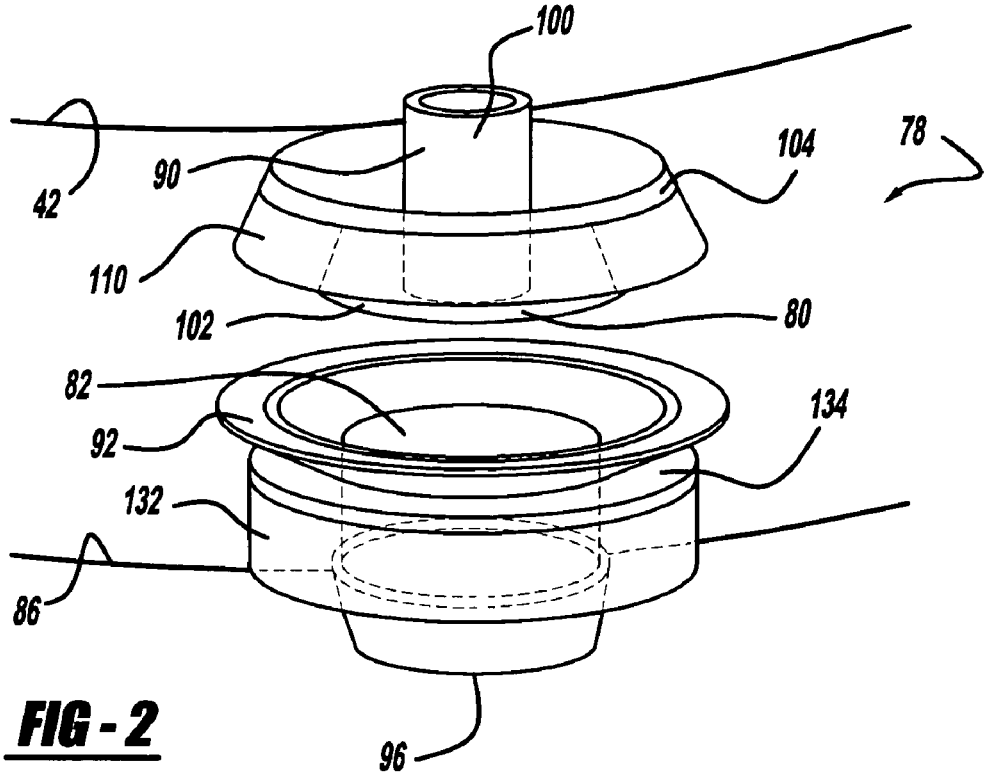
FIG. 2 is a perspective view of an HVAC case drain tube and docking station inlet according to the present teachings.
Figure 3:
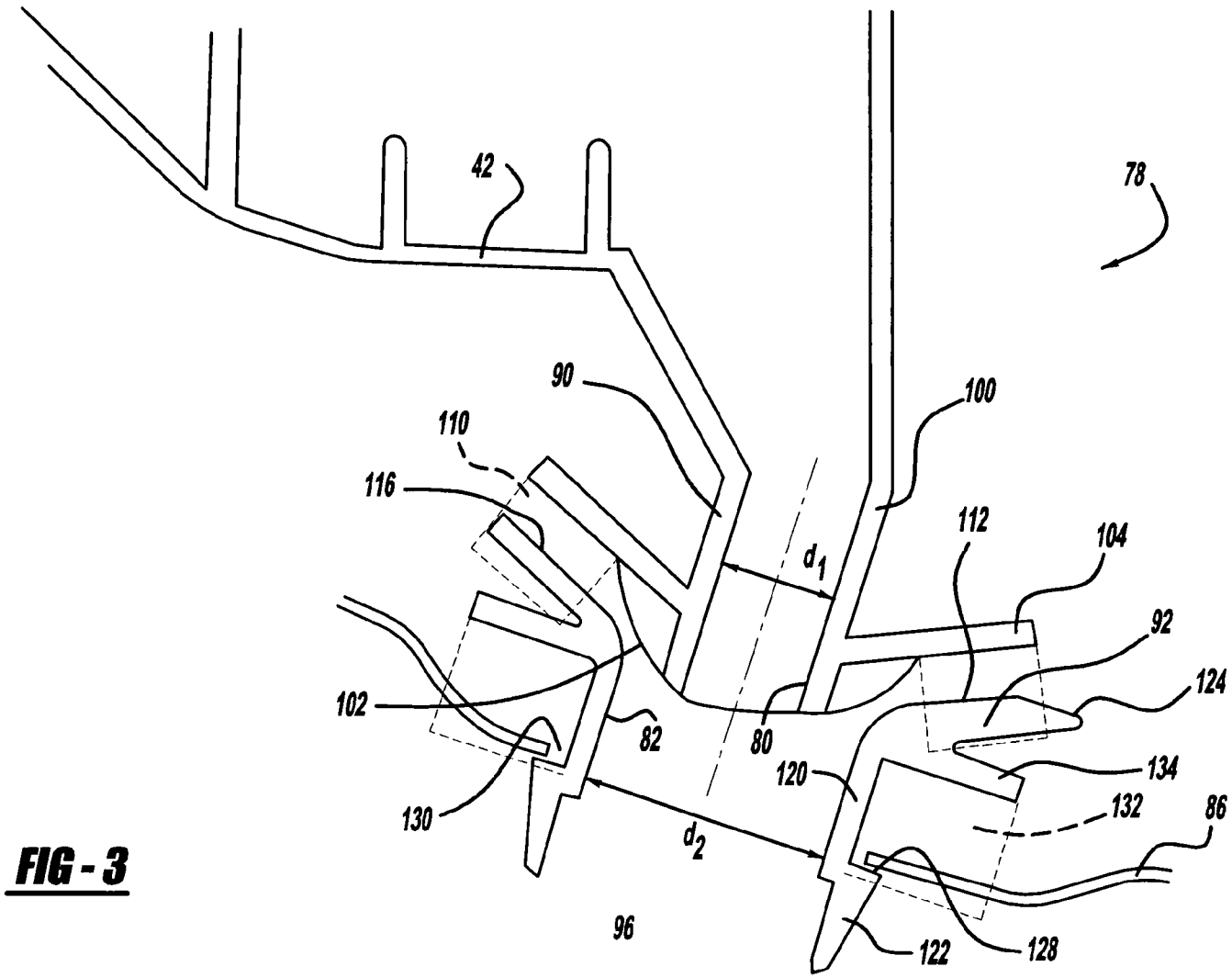
FIG. 3 is a sectional view of the drain tube and docking station inlet of FIG. 2 shown in an installed position.

With further reference now to FIGS. 2 and 3 a mounting arrangement according to the present teachings is shown and generally identified at reference 78. The mounting arrangement 78 generally includes an outlet 80 of the HVAC case 42 and an inlet 82 of a docking station 86. In general, during operation of the evaporator 36, condensation formed on the evaporator 36 drips downward from the evaporator 36 and collects into the HVAC case 42. The condensation drains out of the HVAC case 42 through a drain tube 90 defining the outlet 80. From the outlet 80 of HVAC case 42, the condensation enters the inlet 82 of a receiving portion or drain neck 92 provided on the docking station 86. The drain neck 92 exhausts the condensation through an exit port 96 and onto the ground.

With continued reference now to FIGS. 2 and 3, the drain tube 90 of the HVAC case 42 and the neck 92 of the docking station 86 will be described in greater detail. The mounting arrangement 78 of the present invention facilitates insertion of the drain tube 90 into the neck 92 provided on the docking station 86. As a result, the outlet 80 of the HVAC case 42 may be easily located into the inlet 82 of the neck 92 on the docking station 86 accounting for build tolerance and assembly process variations.

The drain tube 90 generally includes an upstream longitudinal portion 100 defining an inner diameter $d_1$ and a downstream radial portion 102. A flange 104 extends radially around the longitudinal portion 100 and generally tapers toward the radial portion 102. The flange defines a conical cross-section. The radial portion 102 generally defines a bulbous distal portion suitable for nesting into a receiving end of the neck 92. A compressible packing material such as foam 110 is arranged adjacent the flange 104. The compressible packing material 110 may comprise a generally tapered outer contour similar to the flange 104.

The neck 92 of the docking station 86 generally includes an upper funnel portion 112 having an upper seat 116, an intermediate portion 120 defining an inner diameter $d_2$ and a lower insertion portion 122. The upper seat 116 of the neck 92 defines a generally conical contour. A ramp portion 124 is provided on the upper seat 116 for accommodating ingress of the drain tube 90 during assembly as will be described in greater detail.

The seat 116 is arranged to substantially align with the flange 104 and foam 110 of the drain tube 90 on the HVAC case 42 in an assembled position (FIG. 3). An outer ridge 128 defined on the neck 92 is adapted to capture the neck 92 within a passage 130 defined through the docking station 86. A compressible material such as foam 132 is located between an intermediate collar 134 of the neck 92 and the docking station 86 in an assembled position. The compressible material 132 is operable to compress and retract according to interaction between the drain tube 90 and the neck 92. In this way, the characteristics of the compressible material 132 urge the outer ridge 128 of the neck 92 into the docking station 86 maintaining a tight fit. It is appreciated that the compressible material 132 may comprise other materials or alternatively may comprise a mechanical biasing configuration.

With general reference now to FIG. 3 (assembled position) and specific reference to FIGS. 4-7, an assembly sequence for locating the drain tube 90 of the HVAC case 42 into the neck 92 provided on the docking station 86 will be described in further detail. In general, the compressible material 132 allows the neck 92 to rotate in a clockwise direction relative to the docking station 86 as the radial portion 102 of the drain tube 90 slidably engages and eventually clears the ramp 124 to reach the installed position (FIG. 3). As a result of this interaction, the neck 92 and the docking station 86 centralize around the drain tube 90 once installed.

Figure 4:
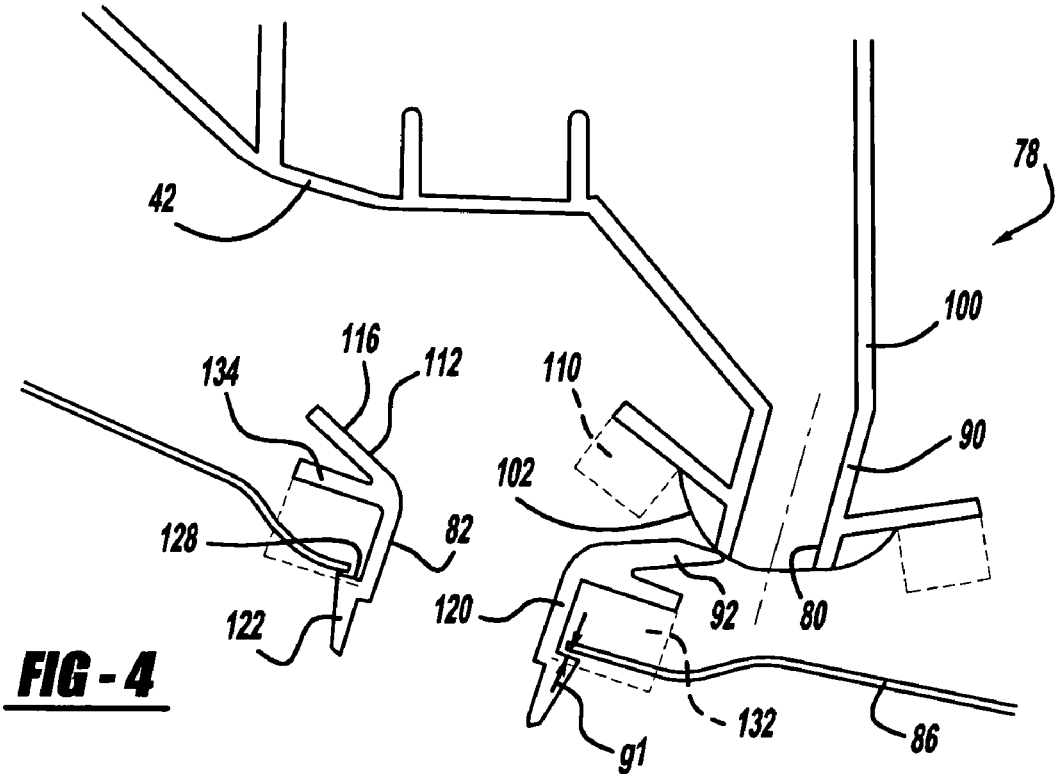
FIGS. 4-7 illustrate an assembly sequence of the drain tube and docking station of FIG. 3 shown with the drain tube moving from an uninstalled position into an assembled position.

FIG. 4 illustrates the drain tube 90 initially contacting the ramp 124 of the neck 92. As illustrated, the compressible material 132 initially compresses causing the neck 92 to rotate clockwise. Explained further, an interface between the ridge 128 and the docking station 86 defines a gap g1 on the portion of the neck 92 corresponding to the ramp 124 (the rightmost portion of the ridge 128 as viewed from FIG. 4). The gap g1 is created by clockwise rotation of the neck 92 about a contact surface on the leftmost portion of the ridge 128 and the corresponding surface of the docking station 86.

Figure 5:
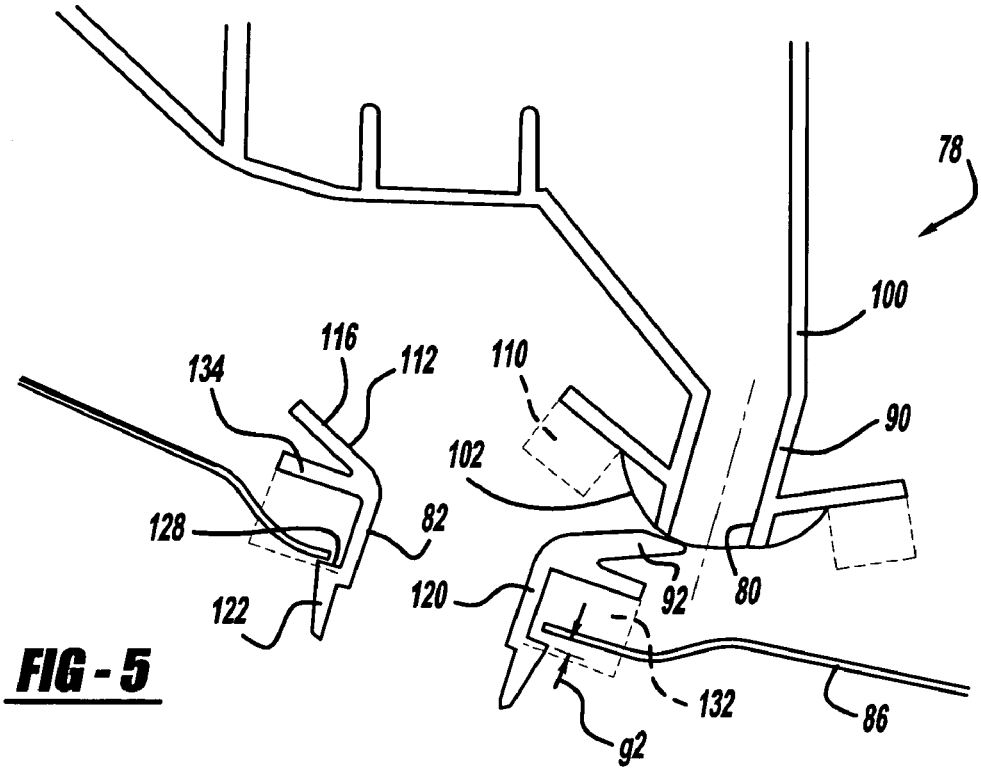
Figure 6:
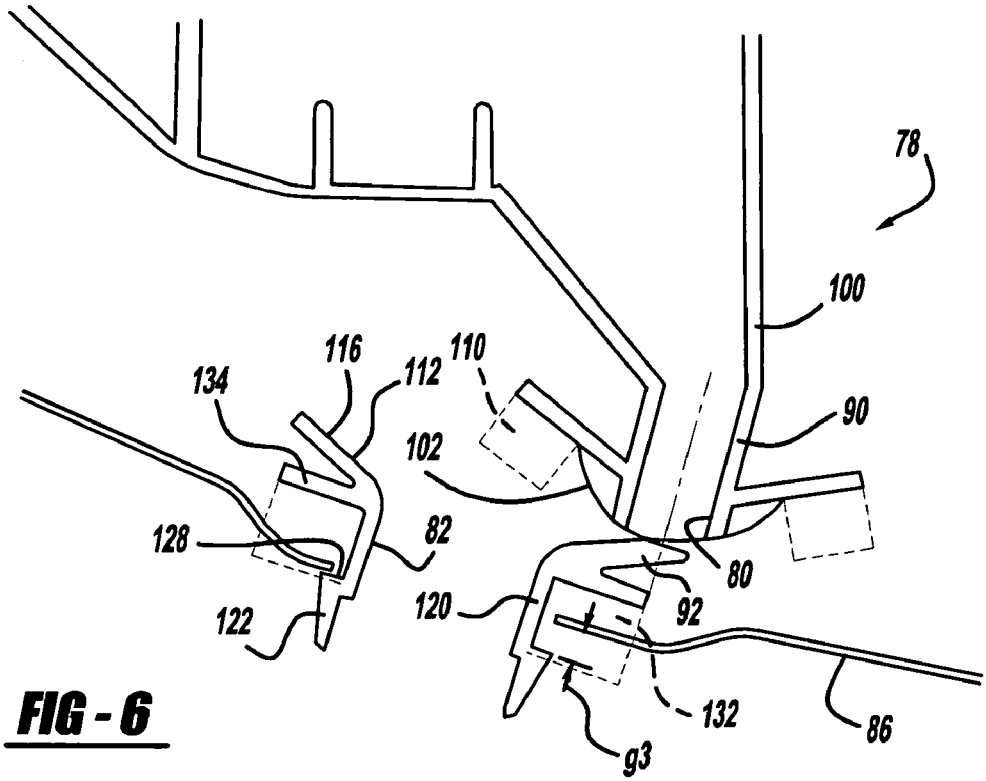

Turning now to FIG. 5, the drain tube 90 is shown shifted leftward relative to FIG. 4. In FIG. 5, the radial portion 102 of the drain tube 90 causes the neck 92 to deflect into the compressible material 132. As a result, the compressible material 132 compresses a distance causing the neck 92 to further rotate clockwise. A gap g2 is defined between the ridge 128 and the docking station 86. FIG. 6 illustrates the drain tube 90 shifted leftward relative to FIG. 5. In FIG. 6 an outermost surface of the radial portion 102 engages an outermost portion of the ramp 124 resulting in the greatest amount of compression in the compressible material 132 and the furthest rotation clockwise of the neck 92. A gap g3 is defined between the ridge 128 and the docking station 86. In general the relative gaps may be represented as g3>g2>g1.

Figure 7:
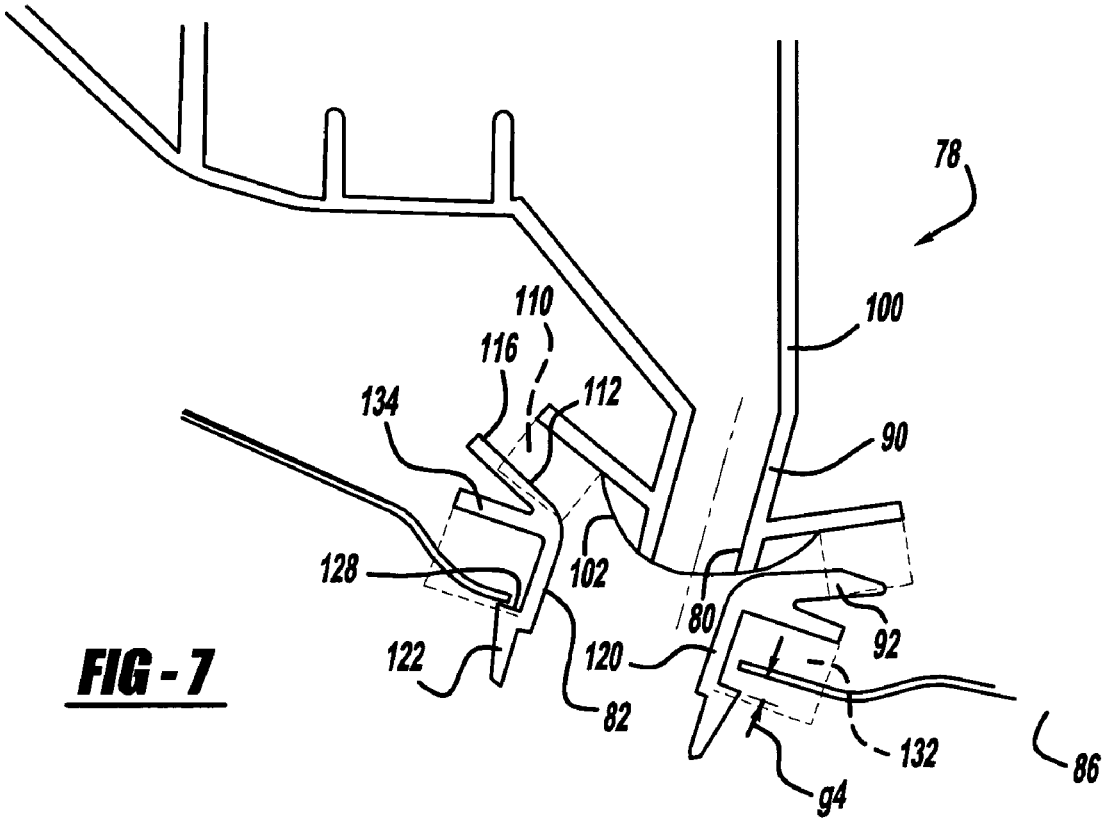

In FIG. 7, the drain tube 90 is shown shifted leftward relative to FIG. 6. The radial portion 102 of the drain tube 90 is shown partially nested into the funnel 112. At this point the compressible material 132 begins to retract or rebound and the neck 92 rotates counterclockwise. In the fully assembled position (FIG. 3), the drain tube 90 nests within the funnel 112. The compressible packing material 110 arranged around the flange 104 of the drain tube 90 partially compresses against the seat 116 to encourage a seal thereat. The dimensional relationship of the radial portion 102 of the drain tube 90 and the funnel portion 112 of the neck 92 encourage the drain tube 90 to centralize relative to the neck 92 in an assembled position.

The drain tube 90 and the neck 92 may be made of a durable, lightweight material such as injection molded plastic for example. It is appreciated that the drain tube 90 may be an integral piece of the HVAC case 42 or alternatively a distinct component attached to the HVAC case 42. Similarly, the neck 92 may alternatively be an integral structure of the docking station 86. Other materials and configurations may also be employed while reaching similar results.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A mounting arrangement for an HVAC case comprising:

a drain tube extending from the HVAC case and defining an outlet;

a neck extending from a docking station and adapted to accept said drain tube in an assembled position; and a first compressible material disposed between said neck and said docking station;

wherein said neck is operable to deflect into said first compressible material upon slidable communication of said drain tube along a surface of said neck.

2. The mounting arrangement of claim 1 wherein said neck is operable to rotate into said first compressible material upon slidable communication of said drain tube along said surface of said neck.

3. The mounting arrangement of claim 2, further comprising a second compressible material disposed between said drain tube and said neck, wherein said second compressible material is adapted to compress between said drain tube and said neck in said assembled position.

4. The mounting arrangement of claim 3 wherein said drain tube defines a flange extending radially therearound.

5. The mounting arrangement of claim 4 wherein said flange defines a conical cross section.

6. The mounting arrangement of claim 5 wherein said drain tube defines a bulbous distal insertion end.

7. The mounting arrangement of claim 3 wherein said neck includes a funnel portion arranged on a first end.

8. The mounting arrangement of claim 7 wherein said neck includes an intermediate collar extending radially therearound, wherein said first compressible material is disposed between said intermediate collar and said docking station.

9. The mounting arrangement of claim 8 wherein said neck is received in a passage defined by said docking station.

10. A mounting arrangement for an HVAC case comprising:

a drain tube extending from the HVAC case and defining an outlet;

a receiving portion extending from a docking station and adapted to accept said drain tube in an assembled position; and wherein said receiving portion is operable to deflect toward said docking station upon slidable communication of said drain tube along a surface of said receiving portion.

11. The mounting arrangement of claim 10, further comprising a first compressible material disposed between said neck and said docking station.

12. The mounting arrangement of claim 11 wherein said receiving portion is operable to deflect into said first compressible material upon slidable communication of said drain tube along said surface of said receiving portion.

13. The mounting arrangement of claim 12, further comprising a second compressible material disposed between said drain tube and said receiving portion, wherein said second compressible material is adapted to compress between said drain tube and said receiving portion in said assembled position.

14. The mounting arrangement of claim 13 wherein said drain tube defines a flange extending radially therearound and wherein said flange defines a conical cross section.

15. The mounting arrangement of claim 14 wherein said drain tube defines a bulbous distal insertion end.

16. The mounting arrangement of claim 15 wherein said receiving portion includes an intermediate collar extending radially therearound, wherein said first compressible material is disposed between said intermediate collar and said docking station.

17. The mounting arrangement of claim 16 wherein said receiving portion is received in a passage defined by said docking station.

18. A mounting arrangement for an HVAC case comprising:

a drain tube extending from the HVAC case and defining an outlet;

a receiving portion extending from a docking station and adapted to accept said drain tube in an assembled position; and wherein said receiving portion is operable to deflect in a direction toward said docking station upon slidable communication of said drain tube along a surface of said receiving portion and wherein said receiving portion is operable to retract in a direction away from said docking station upon further slidable communication of said drain tube along said surface of said receiving portion.

19. The mounting arrangement of claim 18, further comprising a first compressible material disposed between said neck and said docking station and wherein said receiving portion is operable to deflect into said first compressible material upon slidable communication of said drain tube along said surface of said receiving portion.

20. The mounting arrangement of claim 18, further comprising a second compressible material disposed between said drain tube and said receiving portion, wherein said second compressible material is adapted to compress between said drain tube and said receiving portion in said assembled position.

* * * * *